US006955283B2

(12) United States Patent
Kendall et al.

(10) Patent No.: US 6,955,283 B2
(45) Date of Patent: Oct. 18, 2005

(54) ADAPTABLE MANDREL FOR SPIN FORMING

(75) Inventors: Ronnie G. Kendall, Wichita, KS (US); Dwight A. Burford, Wichita, KS (US)

(73) Assignee: The Boeing Company, Chicago, IL (US)

( * ) Notice: Subject to any disclaimer, the term of this patent is extended or adjusted under 35 U.S.C. 154(b) by 210 days.

(21) Appl. No.: 10/657,683

(22) Filed: Sep. 8, 2003

(65) Prior Publication Data

US 2004/0050908 A1 Mar. 18, 2004

(51) Int. Cl.[7] ..... B23K 20/12; B23K 37/00; B21B 27/06; B21D 5/00

(52) U.S. Cl. ..... 228/2.3; 228/2.1; 228/114.5; 72/69; 72/82; 72/83; 72/84; 72/85; 72/94

(58) Field of Search ..... 228/2.1, 2.3, 112.1, 228/114.5; 29/894.32, 894.323, 894.325; 72/82–85, 69, 94, 356

(56) References Cited

U.S. PATENT DOCUMENTS

| | | | | |
|---|---|---|---|---|
| 3,255,518 A | * | 6/1966 | Golata | 29/894.353 |
| 3,779,446 A | * | 12/1973 | Lemelson | 228/15.1 |
| 5,460,317 A | | 10/1995 | Thomas et al. | |
| 5,718,366 A | | 2/1998 | Colligan | |
| 5,833,127 A | * | 11/1998 | Powell et al. | 228/102 |
| 5,937,516 A | * | 8/1999 | De Sousa et al. | 29/890 |
| 6,237,835 B1 | | 5/2001 | Litwinski et al. | |
| 6,398,883 B1 | | 6/2002 | Forrest et al. | |
| 6,539,765 B2 | * | 4/2003 | Gates | 72/69 |

FOREIGN PATENT DOCUMENTS

| | | | |
|---|---|---|---|
| DE | 197 03 947 | | 7/1997 |
| EP | 0 824 049 | | 2/1998 |
| FR | 2 376 708 | | 8/1978 |
| JP | 2000-158071 A | * | 6/2000 |

OTHER PUBLICATIONS

Copy of Search Report for corresponding European Application No. 03029654.5 dated Dec. 17, 2004.

* cited by examiner

*Primary Examiner*—Lynne R. Edmondson
(74) *Attorney, Agent, or Firm*—Alston & Bird LLP

(57) ABSTRACT

There is provided a mandrel for spin forming that has a backing plate with removably attached mandrel portions and mandrel spacers, such that the mandrel is adaptable to numerous configurations. The various configurations of the mandrel are used to provide different spin forming contour surfaces upon which metal sheets or other spin formable materials can be spin formed. The adaptable mandrel also provides the ability to create a desired spin formed product from either a single metal sheet or multiple metal sheets joined by friction stir welding or other suitable processes. A spin formed welded metal sheet may also undergo a trimming process to remove the portions of the welded metal sheet having sufficiently different material properties resulting from the weld process, including the weld joint.

24 Claims, 5 Drawing Sheets

ADAPTABLE MANDREL FOR SPIN FORMING

FIELD OF THE INVENTION

The present invention relates generally to mandrels for spin forming articles. More particularly the invention relates to a single mandrel that may be adapted to a number of configurations.

BACKGROUND OF THE INVENTION

Spin forming is the reshaping of a flat or hollow material using a point deformation process that uses the combined forces of rotation and pressure. Spin forming involves spinning the product on a lathe and plastically deforming the product onto a tooling mandrel that rotates with the product. By deforming the product onto the mandrel, the finished product acquires the contours of the mandrel. Thus, a flat metal sheet can be formed to a desired shape.

A single mandrel can be used to spin form many finished products; however, all the finished products possess only the shape of that individual mandrel. Thus, multiple mandrels are required to form products having different shapes and/or sizes. A mandrel can be costly and take a long time to create; therefore, it is desirable to minimize the number of mandrels required to form numerous products of dissimilar shape because of tooling costs and lead times.

Material costs and lead times are also important considerations in the selection and manufacturing of the materials for spin forming. Generally, raw materials having standard dimensions cost less and can be more quickly procured than raw materials that are uniquely dimensioned. Because many spin forming applications require flat metal sheets with unique dimensions, it is desirable to convert metal sheets of standard size to the metal sheets of unique dimensions, prior to the spin forming process, in a cost-effective manner without adversely affecting the material properties. For example, metal sheets that are of a standard size but that are smaller than the unique dimensions that are desired may be joined together to create a metal sheet with the unique dimensions.

Conventional welding techniques are typically used to join metal sheets; however, some metals, such as high strength precipitation strengthened aluminum alloys, cannot be satisfactorily joined by conventional welding techniques. Friction stir welding is one method of joining metal sheets that addresses the difficulties of welding some aluminum alloys or other materials not easily joined by conventional welding techniques. U.S. Pat. No. 5,460,317 to Thomas et al., discloses a method of friction stir welding. Two sheets of material are friction stir welded by butting the two sheets together and then running a rotating probe along the joint line. The rotating probe creates a local region of highly plasticized material, and the plasticized material is swept by the rotating probe, such that the material of the two sheets join and upon cooling create a butt joint. The friction stir welding process can join two metal sheets; however, the material properties along the joint are sufficiently different from the material properties of the other portions of the sheets of material, such that the welded sheet may not satisfy the same engineering criteria of the base material. Therefore, a friction stir welded metal sheet that is subsequently spin formed creates a finished product with different material properties along the original friction stir weld joint.

Therefore, a need exists for a spin forming mandrel that provides the ability to spin form metal sheets into multiple shapes and/or sizes. Further, a need exists to utilize metal sheets of standard dimensions, that have been joined prior to the spin forming process, in order to create a larger metal sheet with unique dimensions, but without reducing the material properties of the finished product, such as along a weld joint.

BRIEF SUMMARY OF THE INVENTION

The invention addresses the above needs and achieves other advantages by providing an adaptable mandrel for spin forming. The adaptable mandrel includes a backing plate, upon which a first mandrel portion and a second mandrel portion are attached, such that one or more mandrel portions are removably attached. Each of the mandrel portions define a spin forming contour surface. The removably attached mandrel portion or portions may be attached to the backing plate in at least two different positions relative to the other mandrel portion. A first configuration is defined when the first and second mandrel portions abut one another, and a second configuration is defined when the first and second mandrel portions are spaced from one another to define a mandrel gap. The mandrel also includes at least one mandrel spacer that also defines a spin forming contour surface. The mandrel spacer is removably attached to the backing plate to occupy the mandrel gap while the first and second mandrel portions are spaced from one another in the second configuration. Therefore, the mandrel is adaptable to define at least two different continuous spin forming patterns.

In one embodiment of the adaptable mandrel, the backing plate includes through-holes and the first and second mandrel portions and the mandrel spacer include at least one bolt and one dowel pin for positioning in the through-holes of the backing plate. Another embodiment includes a first mandrel portion that is a different shape than the second mandrel portion, such that the first configuration and the second configuration of the mandrel each define a non-concentric pattern. In an alternative embodiment, the first mandrel portion and second mandrel portion both define a semicircular shape, such that the first configuration and the second configuration of the mandrel each define a nominally circular pattern. A further embodiment of the invention includes a mandrel spacer with edges having a curvature similar to the curvature of the mandrel portions, while yet another embodiment includes a mandrel spacer with straight edges.

The invention also provides a spin forming apparatus in operation. The spin forming apparatus includes a mandrel and a metal sheet. The mandrel includes a backing plate, upon which a first mandrel portion and a second mandrel portion are attached, such that one or more mandrel portions are removably attached. Each of the mandrel portions define a spin forming contour surface. The removably attached mandrel portion or portions may be attached to the backing plate in at least two different positions relative to the other mandrel portion. A first configuration is defined when the first and second mandrel portions abut one another, and a second configuration is defined when the first and second mandrel portions are spaced from one another to define a mandrel gap. The mandrel also includes at least one mandrel spacer that also defines a spin forming contour surface. The mandrel spacer is removably attached to the backing plate to occupy the mandrel gap while the first and second mandrel portions are spaced from one another in the second configuration. Therefore, the mandrel is adaptable to define at least two different continuous spin forming patterns upon which the metal sheet may be operably connected to be spin formed. The metal sheet is spin formed on the mandrel to acquire the contours of the spin forming contour surface.

The metal sheet may be a welded metal sheet that includes a first metal sheet welded to a second metal sheet along a weld joint, and the welded metal sheet is operably connected to the mandrel in the second configuration.

A method of manufacturing a spin formed product is also provided by the present invention. The method includes converting the mandrel from a first configuration to a second configuration by moving a first mandrel portion relative to a second mandrel portion. The first configuration defines a continuous spin forming contour surface and the second configuration defines a spin forming contour surface with a mandrel gap between the mandrel portions. A mandrel spacer is inserted into the mandrel gap to complete a second continuous spin forming contour surface. Sheet material is then operably connected to the mandrel and spin formed to define the spin formed product.

Additional embodiments of the manufacturing method may include welding at least two metal sheets together to define the sheet metal material prior to operably connecting the sheet material to the mandrel. The manufacturing method may further include a friction stir welding process to weld the metal sheets and a trimming process to remove the friction stir weld joint and the heat affected zone of the welded sheet.

Therefore, the present invention provides the ability to spin form metal sheets into multiple shapes and/or sizes. In addition, the present invention allows the use of metal sheets of standard dimensions to spin form finished products of substantially equivalent material properties as finished products spin formed from metal sheets of unique dimensions.

BRIEF DESCRIPTION OF THE SEVERAL VIEWS OF THE DRAWINGS

Figure 1:
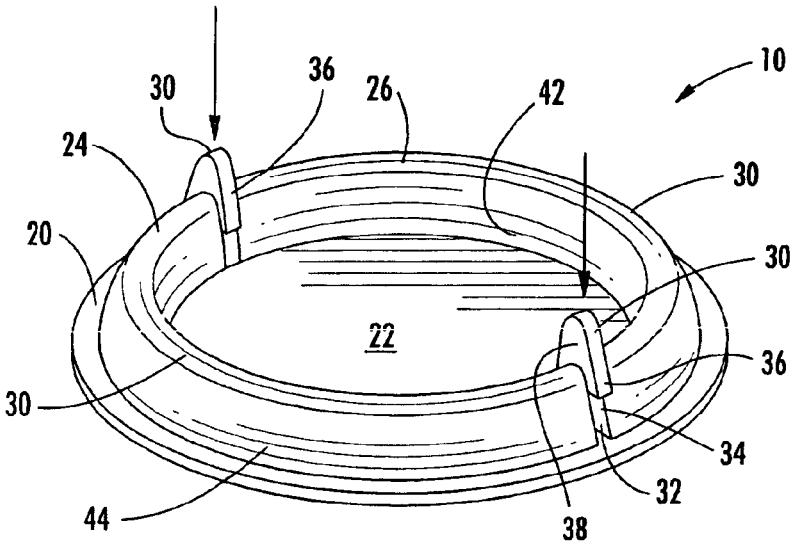
Figure 2:
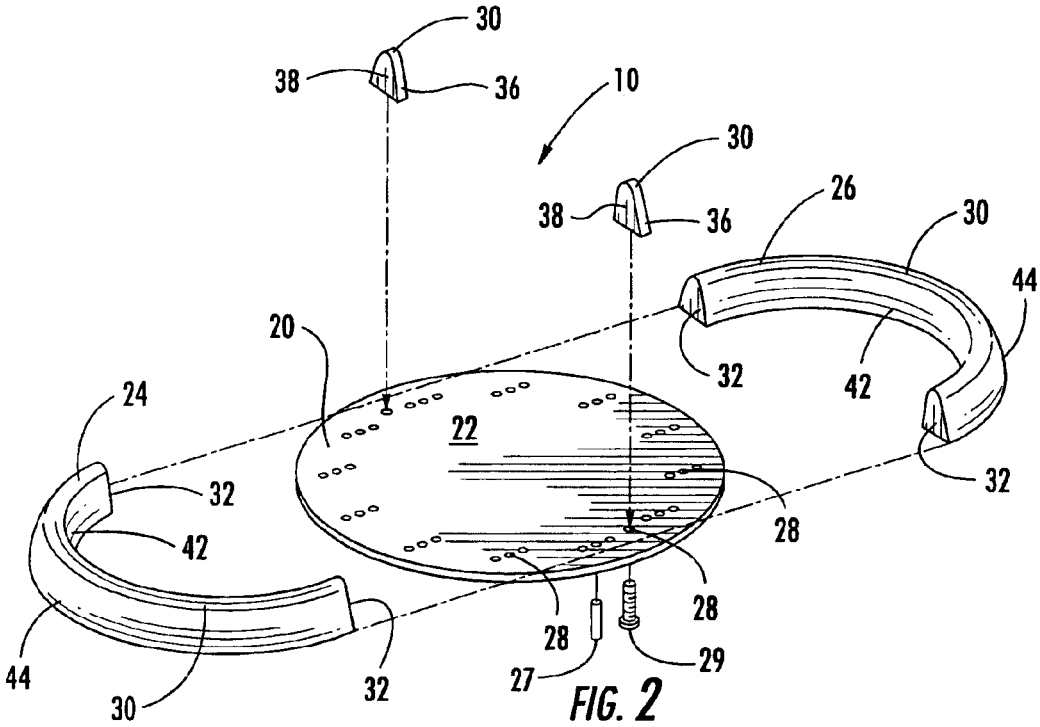
Figure 3:
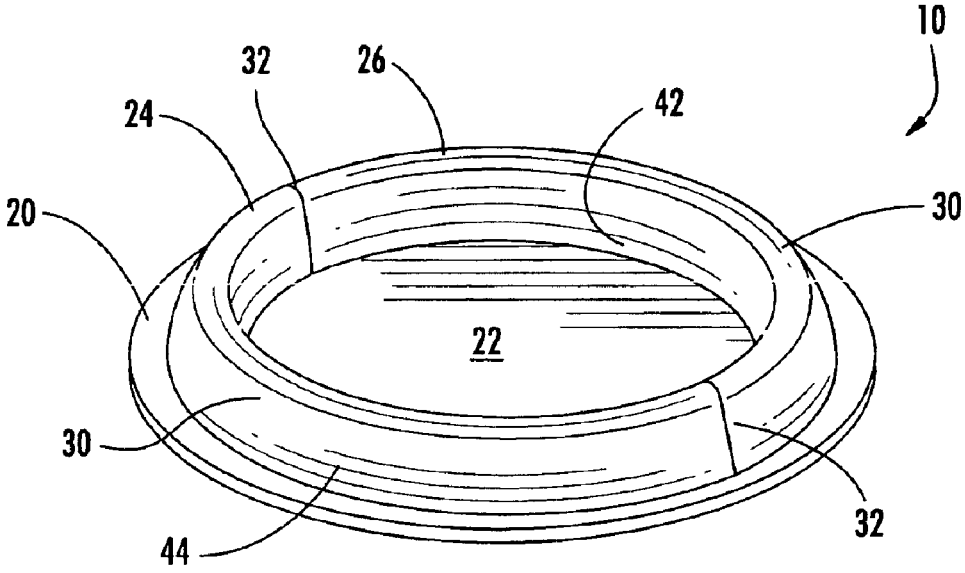
Figure 4:
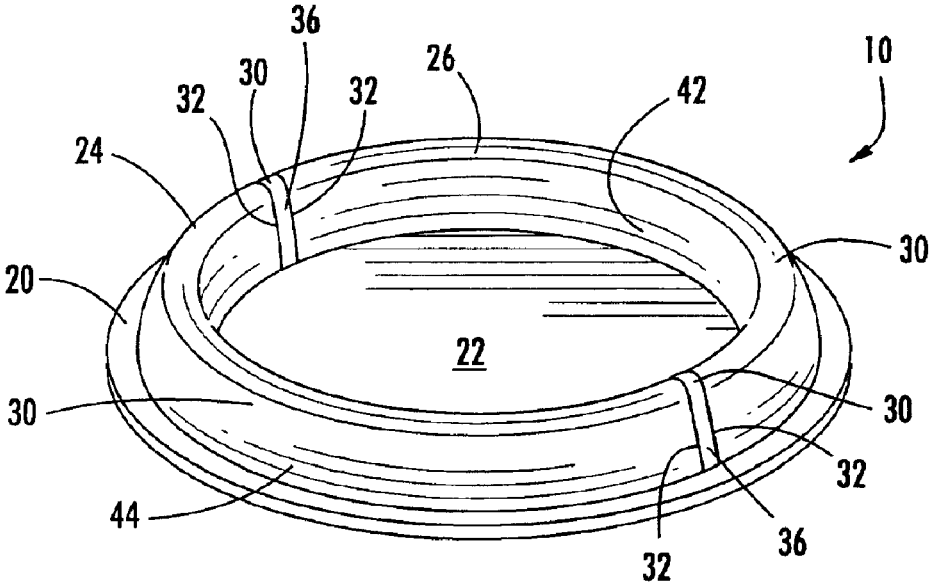
Figure 5:
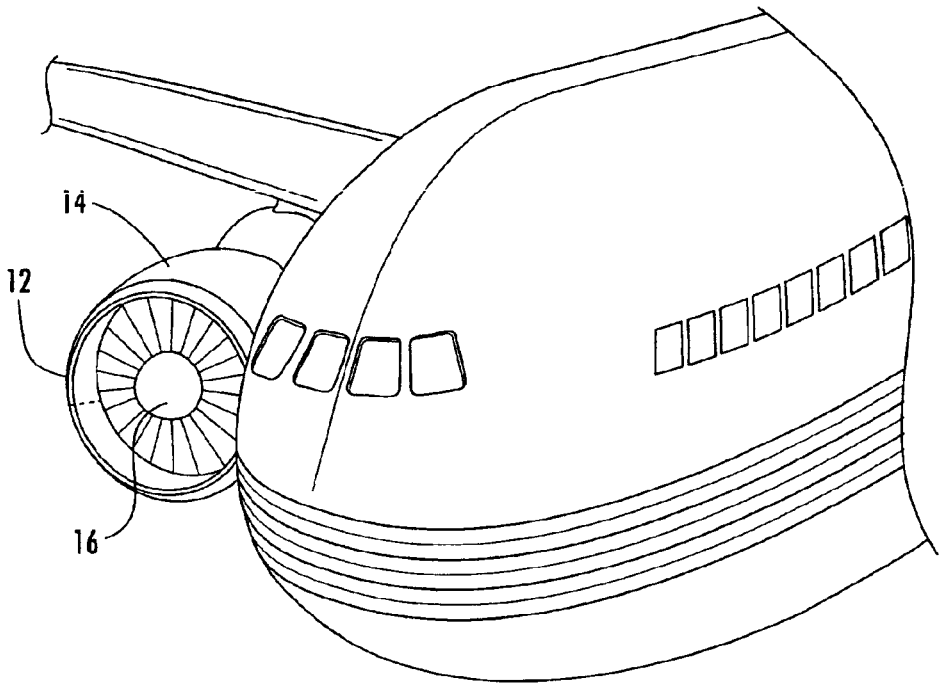
Figure 6:
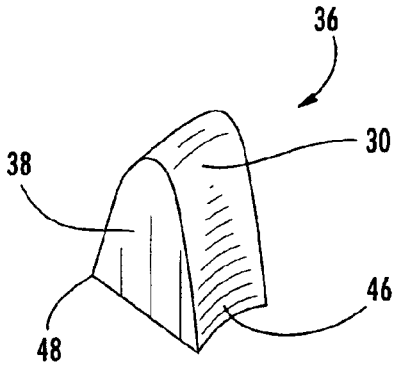
Figure 7:
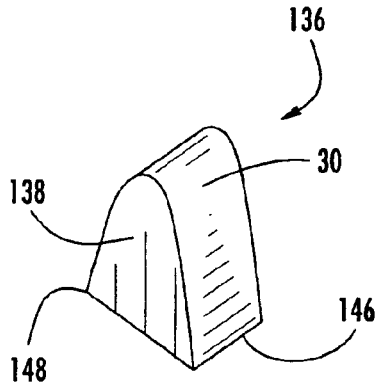
Figure 8:
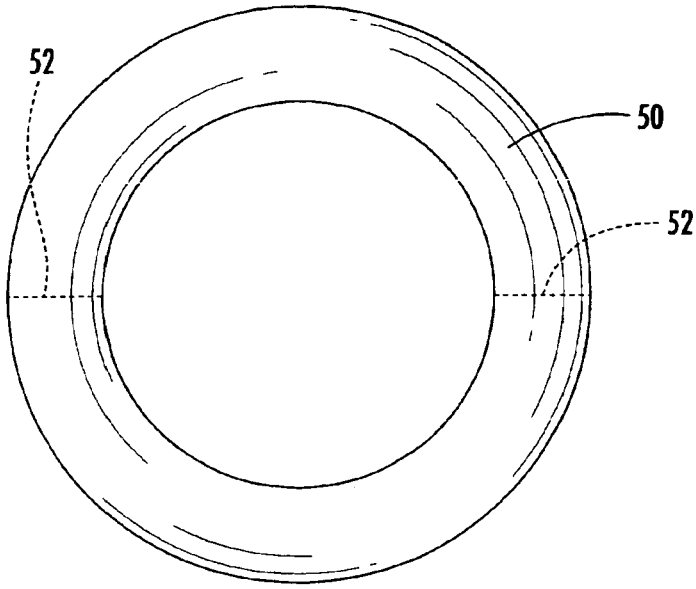
Figure 9:
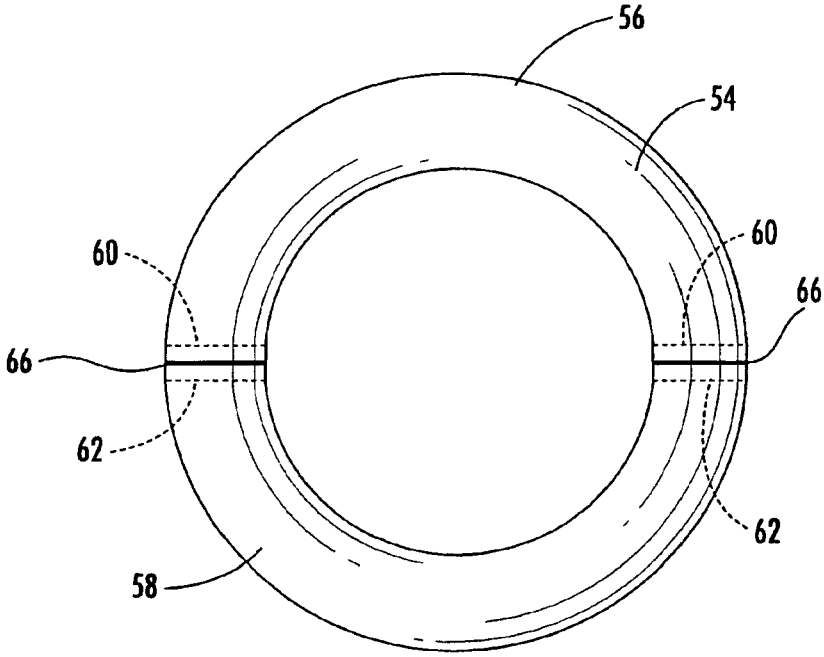
Figure 10:
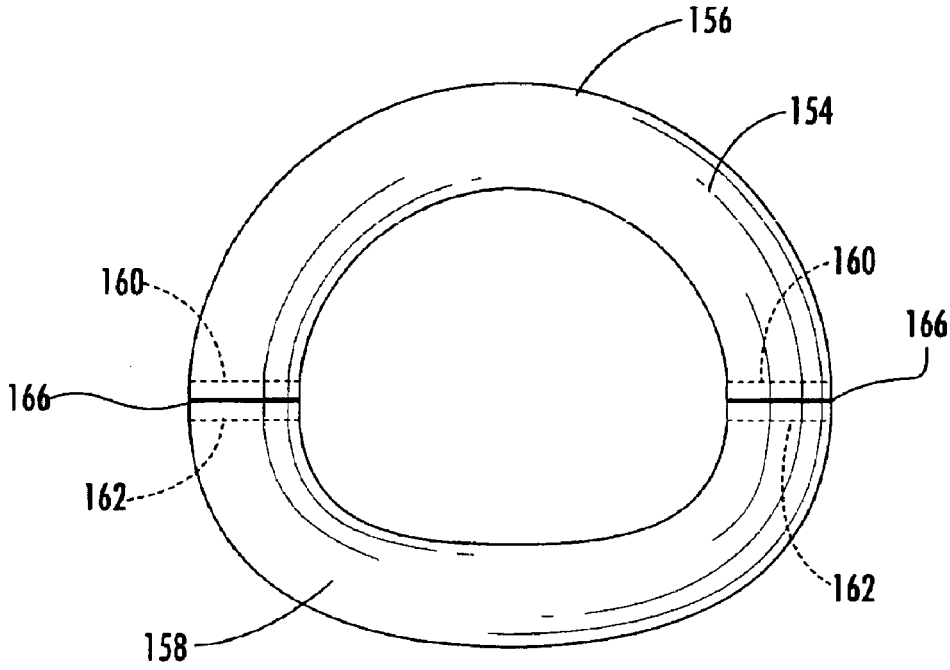
Figure 11:
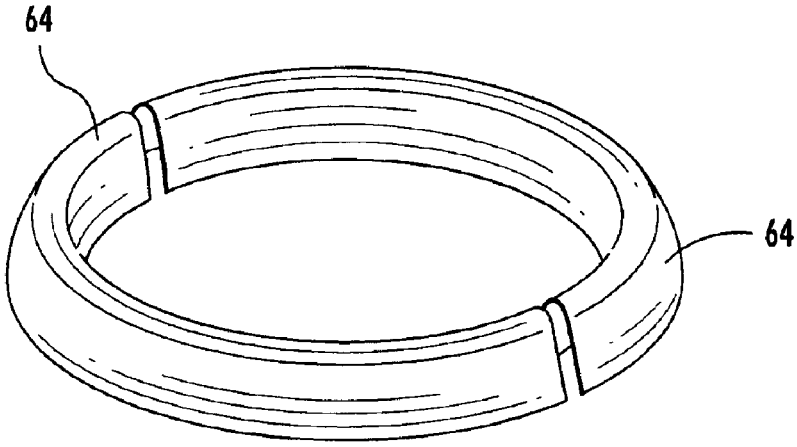

Having thus described the invention in general terms, reference will now be made to the accompanying drawings, which are not necessarily drawn to scale, and wherein:

FIG. 1 is a perspective view of a mandrel for a spin forming process in accordance with an embodiment of the present invention, illustrating the removable mandrel spacers;

FIG. 2 is an exploded view of the mandrel of FIG. 1, showing the through-holes in the backing plate through which the mandrel portions and mandrel spacers are bolted and dowelled;

FIG. 3 is a perspective view of the mandrel of FIG. 1, showing a first configuration of the mandrel, wherein the parting surfaces of the first mandrel portion contact the parting surfaces of the second mandrel portion;

FIG. 4 is a perspective view of the mandrel of FIG. 1, showing a second configuration of the mandrel, wherein the mandrel spacers occupy the mandrel gaps defined by the mandrel portions;

FIG. 5 is a perspective view of a product manufactured with the mandrel of FIG. 1, namely a nacelle inlet lip skin, wherein the nacelle inlet lip skin is shown installed on a jet engine casing;

FIG. 6 is an enlarged view of a mandrel spacer of FIG. 1, showing the inner edge curvature and outer edge curvature of the mandrel spacer;

FIG. 7 is an enlarged view of a mandrel spacer of an alternative embodiment, showing a straight inner edge and a straight outer edge of the mandrel spacer;

FIG. 8 is a top elevation of a single metal sheet after spin forming, showing the lines the formed sheet will be trimmed along;

FIG. 9 is a top elevation of two metal sheets joined by a friction stir welded process after spin forming of the sheets, showing the lines the formed sheet will be trimmed along;

FIG. 10 is a top elevation of two metal sheets joined by a friction stir welded process after spin forming of the sheets, showing the finished product of a mandrel having mandrel portions of different shape and showing the lines the formed sheet will be trimmed along; and FIG. 11 is a perspective view of the finished material of FIG. 8 or FIG. 9 after the trimming and removal of excess material.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A mandrel 10 in accordance with one embodiment of the invention is illustrated in FIGS. 1–4. The mandrel 10 of the illustrated embodiment is used in the spin forming of the nacelle inlet skin lip 12, as illustrated in FIG. 5. The nacelle inlet skin lip 12 is mounted to the forward edge of a jet engine casing 14, such as a nacelle, and directs the air into or around the jet engine 16 during normal operation. The nacelle inlet skin lip 12 is a ring of curved sheet metal that is spin formed on a mandrel, such as the mandrel 10 of FIG. 1, and then cut into a two-part ring prior to assembly onto the jet engine casing 14. The mandrel 10 of the present invention may be used in the spin forming of any spin formed component and is not limited to a nacelle inlet skin lip 12.

The mandrel 10 of FIG. 1 includes a backing plate 20, which includes a generally planar surface 22. The mandrel 10 also includes a first mandrel portion 24 and a second mandrel portion 26 that are removably attached to the generally planar surface 22 of the backing plate 20. In further embodiments of the invention, additional mandrel portions may be included and the mandrel may include one or more mandrel portions that are rigidly attached to the backing plate 20. In an embodiment where one mandrel portion is removably attached and another mandrel portion is rigidly attached, counterbalances may be added to the mandrel 10 so that the mandrel can be balanced for spinning. Such balance weights may also be used in mandrels having multiple mandrel portions that are removably attached.

The backing plate 20 of the illustrated embodiment is nominally circular, and the mandrel portions 24 and 26 are also nominally circular. Other embodiments of the invention may include a backing plate 20 and mandrel portions 24 and 26 of any geometric shape possible for spin forming. Examples of spin forming patterns created from the geometric shapes of the mandrel portions 24 and 26 include, but are not limited to, elliptical, oblong, and non-concentric patterns. The mandrel portions 24 and 26 of the illustrated embodiment are mounted to the backing plate 20 using through-holes 28 in the backing plate, as shown in FIG. 2, through which the mandrel portions are dowelled with dowel pins 27 and/or bolted with bolts 29 that are included with the mandrel portions. The location of through-holes 28 in the backing plate 20 allow the mandrel portions 24 and 26 to be mounted to the backing plate in a number of relative positions. The mandrel portions 24 and 26 of further embodiments can be fastened by alternative fasteners or be movably mounted to the backing plate 20 in alternative fashions, such as slidably mounting the mandrel portions with bolts through slots in the backing plate. To adapt the configuration of the mandrel 10, the mandrel portions 24 and 26 are moved to different relative positions, which convert the pattern of the spin forming surface upon which the metal sheet will be spin formed upon.

The mandrel portions 24 and 26 of the illustrated embodiment define a spin forming contour surface 30 on a surface of the mandrel portion opposite the backing plate 20. The contour surface 30 of the illustrated mandrel 10 is a convex arc; however, other embodiments of the mandrel may include any geometric shape possible for spin forming. The mandrel portions 24 and 26 also include a parting surface 32 at each terminating edge of the contour surface 30, as shown in FIGS. 1 and 2. The parting surface 32 of the illustrated mandrel 10 is generally perpendicular to the backing plate 20 and to the contour surface 30; however, other embodiments of the parting surface may be at any angle relative to the backing plate or contour surface. The parting surfaces 32 of each mandrel portion 24 or 26 are identical to, and are configured to engage, the parting surface of the neighboring mandrel portion when the parting surfaces are contacting one another, as shown in FIG. 3. Thus, when the mandrel 10 is assembled such that the mandrel portions 24 and 26 abut one another, as illustrated in FIG. 3, the mandrel defines a spin forming contour surface 30 of one size.

When the mandrel portions 24 and 26 are removably attached to the backing plate such that the parting surfaces do not abut one another, such that the mandrel portions are spaced from one another, as seen in FIG. 1, to define a mandrel gap 34, into which at least one mandrel spacer 36 may be inserted. The mandrel spacers 36 are removably attached to the backing plate 20 with dowel pins 27 and/or bolts 29, as shown in FIG. 2, or by similar fastening methods. A mandrel spacer 36, as illustrated in FIGS. 6 and 7, includes a spin forming contour surface 30 that corresponds to the contour surface of the mandrel portions. Thus, one spin forming contour surface 30 of the mandrel spacer 36 may be identical to that of the mandrel portions 24 and 26 or may otherwise provide a desired transition between the contour surfaces of the mandrel portions. The mandrel spacer 36 also includes two mandrel portion engaging surfaces 38 at each terminating edge of the contour surface 30 of the spacer. Each mandrel portion engaging surface 32 of the mandrel spacer 36 is identical to, and is configured to engage, the parting surface 32 of the neighboring mandrel portion 24 or 26 when the mandrel spacer is inserted into the mandrel gap 34. More than one mandrel spacer 36 can be inserted into a mandrel gap 34, and in such a case, the mandrel portion engaging surface 32 engages the engaging surface of the neighboring mandrel spacer or the parting surface 32 of the neighboring mandrel portion 24 or 26. Thus, when the mandrel 10 is assembled such that the mandrel portions are spaced from one another to define a mandrel gap 34 and the mandrel spacers 36 occupy the mandrel gap, as illustrated in FIG. 4, the mandrel defines a spin forming contour surface 30 of a second size.

The mandrel spacers 36 allow the mandrel 10 to convert from a first configuration of FIG. 3 to a second configuration of FIG. 4 to define at least two different continuous spin forming patterns. The first configuration of FIG. 3 defines a continuous spin forming pattern created by the spin forming contour surfaces 30 of the mandrel portions 24 and 26. To convert the mandrel 10 to the second configuration of FIG. 4, the second mandrel portion 26 and/or the first mandrel portion 24 is moved relative to the other mandrel portion and the mandrel spacers 36 are inserted into the mandrel gaps 34. The second configuration of FIG. 4 defines a continuous spin forming pattern created by the spin forming contour surfaces 30 of the mandrel portions 24 and 26 and the mandrel spacers 36. Additional configurations may be created by moving the mandrel portions 24 and/or 26, by adding additional mandrel portions, by adding additional mandrel spacers 36, or by combining any of the preceding alternatives.

The mandrel 10 of FIGS. 1–4 defines a continuous spin forming contour surface that is a nominally circular pattern. The mandrel 10 consists of two semicircular mandrel portions 24 and 26 that define an inner diameter curvature along an inside surface 42 and an outer diameter curvature along an outside surface 44. Therefore, when the mandrel 10 is in the first configuration illustrated in FIG. 3, the mandrel defines a nominally circular pattern.

The mandrel spacer 36, as shown in FIG. 6, and the mandrel spacer 136 of an alternative embodiment, as shown in FIG. 7, have an inner edge 46, or 146, and an outer edge 48, or 148, respectively. The inner edge 46 of the mandrel spacer 36 of FIG. 6 includes an equivalent inner diameter curvature as the inside surface 42 of the mandrel portions 24 and 26, and the outer edge 48 of the mandrel spacer includes an equivalent outer diameter curvature as the outside surface 44 of the mandrel portions. Therefore, a mandrel 10 incorporating the mandrel spacers 36 of FIG. 6 in the second configuration will define a nominally circular pattern with continuously curving inner and outer edges. The inner edge 146 of the mandrel spacer 136 of FIG. 7 defines a linear edge perpendicular to the mandrel portion engaging surfaces 138 and an outer edge 148 defines a linear edge perpendicular to the mandrel portion engaging surfaces. Therefore, a mandrel 10 incorporating the mandrel spacers 136 will not define a perfectly circular pattern because of the straight edges of the mandrel spacers. However, the mandrel 10 with the mandrel spacer 136 of FIG. 7 still defines a nominally circular pattern because the straight portion of the mandrel spacer is small relative to the overall pattern of the mandrel. If the mandrel spacer 136 defines a substantial width, then the overall continuous spin forming pattern of the mandrel 10 will generally be more oblong than circular, in one embodiment of the mandrel. While two embodiments of the mandrel spacers are shown, the mandrel spacers of alternative embodiments could be of any shape and size to occupy a mandrel gap defined by the mandrel portions.

Once the mandrel 10 is assembled in one of the configurations and the mandrel portions 24 and 26 and/or mandrel spacers 36 are securely attached to the backing plate 20, the mandrel can be used to spin form a metal sheet into a spin formed product. The mandrel 10 of the present invention may also be used to spin form raw materials other than metal sheets. The spin forming process generally involves placing the metal sheet, or other spin formable materials, onto the mandrel, such that the metal sheet is operably connected to the mandrel, and then spinning the two together. While the sheet and mandrel are spinning, a force is applied at a relatively fixed point, such that the sheet material plastically deforms as it rotates past the point such that the sheet material acquires the contours of the contour surface. Upon completion, the spin formed sheet is removed from the mandrel. FIG. 8 illustrates a single metal sheet 50 after the spin forming process and prior to trimming of the sheet. While some spin formed products may be left as a single finished product, other spin formed products, such as the nacelle inlet lip skin, may be separated into multiple parts after spin forming. Trim line 52 of FIG. 8 illustrates the plane along which the spin formed single metal sheet 50 will be trimmed.

In some embodiments, it is advantageous to join multiple sheets to form a sheet that will be spin formed. For example, spin forming may require sheet with unique dimensions that could be expensive, while two or more sheets of conventional dimensions that are less expensive could be welded together to define a sheet for spin forming. FIG. 9 illustrates a welded metal sheet 54, comprising a first metal sheet 56 and a second metal sheet 58 joined together by a friction stir welding process, after the spin forming process and prior to trimming of the sheet. Trim lines 60 and 62 of FIG. 9 illustrate the planes along which the spin formed welded metal sheet 54 will be trimmed. In contrast to FIG. 8, the welded metal sheet 54 of FIG. 9 is trimmed on either side of the weld joint to remove the joint and the portions of the material affected by the welding process. To compensate for the additional material removed from the welded metal sheet 54 of FIG. 9, compared to the material removed from the single metal sheet 50 of FIG. 8, the welded metal sheet includes additional material size prior to trimming, such that the resulting trimmed products are substantially equivalent.

FIG. 10 illustrates an alternative embodiment of a spin formed welded metal sheet 154. The welded sheet 154 includes a first metal sheet 156 and a second metal sheet 158 joined along a weld joint 166. The mandrel upon which the welded sheet 154 was spin formed upon had a first mandrel portion with a different shape than the second mandrel portion. Thus, the resulting contour of the first metal sheet 156 is different than the resulting contour of the second metal sheet 158. After trimming along trim lines 160 and 162, the upper and lower portions of the finished product are of dissimilar shapes. FIGS. 8–10 show the spin formed metal sheets 50, 54, and 154, respectively, after the excess material that was not spin formed is removed. FIG. 11 illustrates a spin formed product 64 after the trimming of the single metal sheet 50 of FIG. 8 or the trimming of the welded metal sheet 54 of FIG. 9.

To create the welded metal sheet 54 of FIG. 9, two or more individual metal sheets may be joined by friction stir welding or by other suitable processes. The process of friction stir welding is disclosed in U.S. Pat. No. 5,460,317 to Thomas et al., the disclosure of which is incorporated herein. Friction stir welding can join two individual sheets of material that include, but are not limited to, aluminum, aluminum alloys, titanium, titanium alloys, steel, and the like. Non-metal materials, such as polymers and the like, can also be welded by friction stir welding. Further, the sheets to be welded can include members of similar or dissimilar materials, for example, sheets of different metals, including metals that are unweldable or uneconomical to join by conventional fusion welding techniques. Unweldable materials, when joined by conventional fusion welding techniques, produce relatively weak weld joints that tend to crack during weld solidification. Such materials include aluminum and some aluminum alloys, particularly AA series 2000 and 7000 alloys. The use of friction stir welding permits sheets of unweldable materials to be securely joined. Friction stir welding also can be used to securely join weldable sheets to other weldable and unweldable materials. Thus, the materials that form the welded sheet, such as the welded metal sheet 54 of FIG. 9, can be chosen from a wider variety of metals and alloys.

The welded metal sheet 54 of FIG. 9 includes a friction stir welded joint 66. Typically, the joint 66 of a friction stir welded metal sheet 54 has material properties sufficiently different than the material properties of the portions of the metal sheet not affected by the friction stir welding process. A sheet having areas of different material properties may not be desirable for certain applications; therefore, the welded metal sheet 54 of the illustrated embodiment is trimmed along the friction stir weld joint 66 during the trimming step to remove the portions of the metal sheet affected by the friction stir welding process, such as the heat affected zone proximate the joint, as well as the actual weld joint. Further embodiments of the invention may trim only a fraction of the joint 66 and/or the affected portion of the metal sheet, or may trim the metal sheet 54, such that none of the joint and/or affected portion is removed, to list two non-limiting examples of trim lines.

The spin forming process is substantially the same for a single metal sheet 50 or for a welded metal sheet 54 joined by a friction stir welding process or other suitable process. The backing plate 20 of the mandrel 10 is attached to a rotating device, one non-limiting example being a lathe, such that the mandrel 10 is able to rotate. The components of the illustrated mandrel 10 are manufactured from a tool steel; however, any material with the material properties and structural strength to withstand repeated spin forming cycles may be used. The metal sheet 50 or 54 is operably connected to the mandrel 10, such that the mandrel and metal sheet rotate together. The metal sheet illustrated in FIGS. 8–10 is an aluminum alloy, such as 2219 aluminum, though any material that can be plastically deformed could be used, such as a polymer. Once the mandrel 10 and the metal sheet 50 or 54 are rotating at a sufficient speed, a tool bit progressively pushes the material of the metal sheet onto the mandrel, such that the resulting metal sheet acquires the contours of the mandrel contour surface 30. FIG. 8 illustrates the resulting metal sheet 50 of a single sheet after spin forming, and FIG. 9 shows the resulting welded metal sheet 54 after spin forming.

A mandrel 10 in the first configuration of FIG. 3 is used to spin form the metal sheet 50 of FIG. 8, while a mandrel in the second configuration of FIG. 4 is used to spin form the welded metal sheet 54 of FIG. 9. Further embodiments of the invention define a mandrel for spin forming a single metal sheet in a first configuration, a second configuration, and any number of other configurations. Likewise, a mandrel can also be used to spin form a welded metal sheet in a first configuration, a second configuration, and any number of other configurations. The welded metal sheet 54 does not always require the use of mandrel spacers 36, though in the illustrated embodiment, the spacers are used to accommodate the extra sheet material of the welded metal sheet, that is, the extra sheet material that compensates for the width of the heat affected zone that is trimmed from the welded metal sheet.

FIG. 8 represents one example of a metal sheet 50 of 0.180"×142"×142" aluminum, and FIG. 9 represents another example of two metal sheets 56 and 58 each of 0.180"×72"×142" aluminum friction stir welded together along the 142" side to create a welded metal sheet 54 of 0.180"×144"×142" aluminum, such dimensions being non-limiting examples for illustrative purposes. The preceding dimensions are used because aluminum plate of 0.180" thickness is more easily obtained in 72" widths relative to aluminum plate of 0.180" thickness in 142"×142" squares. Therefore, the welded metal sheet 54 is two inches wider, which becomes the additional material removed between the trim lines 60 and 62 shown in FIG. 9.

The metal sheet 50 illustrated in FIG. 8 includes a trim line 52, along which the spin formed sheet will be cut either before or after the removal of the portions of the sheet that were not contoured during the spin forming process. The welded metal sheet 54 illustrated in FIG. 9 includes two trim lines 60 and 62, along which the spin formed welded metal sheet will be cut either before or after the removal of the portions of the welded metal sheet that were not contoured during the spin forming process. The friction stir weld joint 66 of the welded metal sheet 54 is removed when the welded metal sheet is trimmed along upper trim line 60 and the lower trim line 62.

FIG. 11 illustrates a spin formed product 64 created after the trimming and removal of excess material from the metal sheet 50. FIG. 11 also illustrates a spin formed product 64 created after the trimming and removal of excess material from the welded metal sheet 54. Therefore, the final product of the single metal sheet 50 and the final product of the welded metal sheet 54 are substantially equivalent, such that the spin formed products 64 have substantially equal dimensions and material properties. The trimming of the welded metal sheet 54 of FIG. 9 along the trim lines 60 and 62 removed the friction stir weld joint 66 and the material of the welded metal sheet affected by the friction stir welding process. The trimming also reduces the dimensions of the welded metal sheet 54, such that the resulting spin formed product 64 is substantially equivalent in size to the spin formed product created from the single metal sheet 50. Therefore, a single mandrel 10 can be adapted from a first configuration to a second configuration to allow spin forming of a single metal sheet 50 and a welded metal sheet 54, respectively, which after trimming result in a substantially equivalent finished product. Further embodiments of the present invention may produce spin formed products 64 of different shape, size, and material properties from either the single or welded metal sheets.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An adaptable mandrel for spin forming, comprising:

a backing plate;

a first mandrel portion defining a spin forming contour surface and attached to the backing plate;

a second mandrel portion defining a spin forming contour surface removably attached to the backing plate, such that the second mandrel portion is attachable to the backing plate in at least two different positions relative to the first mandrel portion, wherein a first configuration is defined when the second mandrel portion is attached to the backing plate, such that the first and second mandrel portions abut one another and a second configuration when the first and second mandrel portions are spaced from one another to define a mandrel gap; and at least one mandrel spacer defining a spin forming contour surface, wherein the mandrel spacer is removably attached to the backing plate, and wherein the mandrel spacer is structured and arranged to occupy the mandrel gap while the first and second mandrel portions are spaced from one another in the second configuration, such that the mandrel is adaptable to define at least two different continuous spin forming patterns.

2. An adaptable mandrel according to claim 1, wherein the first mandrel portion is removably attached to the backing plate.

3. An adaptable mandrel according to claim 2, wherein the backing plate includes through-holes and the first and second mandrel portions and the mandrel spacer include at least one bolt and one dowel pin for positioning in the through-holes of the backing plate.

4. An adaptable mandrel according to claim 1, wherein the first mandrel portion defines a shape that is different than a shape of the second mandrel portion.

5. An adaptable mandrel according to claim 4, wherein the first configuration of the mandrel and the second configuration of the mandrel define a non-concentric pattern.

6. An adaptable mandrel according to claim 1, wherein the first and second mandrel portions each define a semicircular shape and the spin forming contour surface defines a convex arc.

7. An adaptable mandrel according to claim 6, wherein the first configuration of the mandrel and the second configuration of the mandrel define a nominally circular pattern.

8. An adaptable mandrel according to claim 6, wherein the semicircular shape of the first and second mandrel portions defines an inner diameter curvature and an outer diameter curvature, and wherein the mandrel spacer defines an inner edge with the inner diameter curvature and an outer edge with the outer diameter curvature.

9. An adaptable mandrel according to claim 6, wherein the semicircular shape of the first and second mandrel portions define an inner diameter curvature and an outer diameter curvature, and wherein the mandrel spacer defines a linear inner edge and a linear outer edge.

10. An adaptable mandrel according to claim 1, wherein the backing plate defines a generally planar surface.

11. A spin forming apparatus in operation, comprising:

a mandrel, comprising:

a backing plate;

a first mandrel portion defining a spin forming contour surface and attached to the backing plate;

a second mandrel portion defining a spin forming contour surface removably attached to the backing plate, such that the second mandrel portion is attachable to the backing plate in at least two different positions relative to the first mandrel portion, wherein a first configuration is defined when the second mandrel portion is attached to the backing plate, such that the first and second mandrel portions abut one another and a second configuration when the first and second mandrel portions are spaced from one another to define a mandrel gap; and at least one mandrel spacer defining a spin forming contour surface, wherein the mandrel spacer is removably attached to the backing plate, and wherein the mandrel spacer is structured and arranged to occupy the mandrel gap while the first and second mandrel portions are spaced from one another in the second configuration, such that the mandrel is adaptable to define at least two different continuous spin forming patterns;

a metal sheet operably connected to the mandrel, wherein the metal sheet is spin formed on the mandrel to acquire the contours of the spin forming contour surface.

12. A spin forming apparatus according to claim 11, wherein the metal sheet is a welded metal sheet including a first metal sheet welded to a second metal sheet along a weld joint, and wherein the welded metal sheet is spin formed on the mandrel in the second configuration to acquire the contours of the spin forming contour surface.

13. A spin forming apparatus according to claim 11, wherein the metal sheet is a single metal sheet, and wherein the single metal sheet is spin formed on the mandrel in the first configuration to acquire the contours of the spin forming contour surface.

14. A spin forming apparatus according to claim 11, wherein the backing plate includes through-holes and the first and second mandrel portions and the mandrel spacer include at least one bolt and one dowel pin for positioning in the through-holes of the backing plate.

15. A spin forming apparatus according to claim 11, wherein the first mandrel portion defines a shape that is different than the shape of the second mandrel portion.

16. A spin forming apparatus according to claim 11, wherein the first and second mandrel portions each define a semicircular shape and the spin forming contour surface defines a convex arc.

17. A spin forming apparatus according to claim 14, wherein the semicircular shape of the first and second mandrel portions defines an inner diameter curvature and an outer diameter curvature, and wherein the mandrel spacer defines an inner edge with the inner diameter curvature and an outer edge with the outer diameter curvature.

18. A method of manufacturing a spin formed product, comprising the steps of:

converting a mandrel from a first configuration to a second configuration by moving a first mandrel portion relative to a second mandrel portion, wherein the first configuration defines a first continuous spin forming contour surface and the second configuration defines a spin forming contour surface with at least one mandrel gap between the mandrel portions;

inserting at least one mandrel spacer with a spin forming contour surface into the mandrel gap to complete a second continuous spin forming contour surface;

operably connecting a sheet material to the mandrel; and spin forming the sheet material into the spin formed product.

19. A method as defined in claim 18, further comprising the step of welding at least two metal sheets together to define the sheet material prior to operably connecting the sheet material to the mandrel.

20. A method as defined in claim 19, wherein the welding step comprises a friction stir welding process, such that the metal sheets are joined along a friction stir welded joint.

21. A method as defined in claim 20, wherein the operably connecting step comprises orienting the welded sheet material upon the mandrel prior to spin forming, such that the friction stir welded joint is positioned upon the mandrel spacer.

22. A method as defined in claim 20, further comprising the step of trimming the spin formed product generally along the friction stir weld joint to remove the friction stir weld joint.

23. A method as defined in claim 20, further comprising the step of trimming the spin formed product generally along the friction stir weld joint to remove the friction stir welded joint and the heat affected zone of the welded sheet material.

24. A method as defined in claim 18, further comprising the step of balancing the mandrel prior to operably connecting the sheet metal.

* * * * *